United States Patent [19]

Brosch

[11] Patent Number: 4,715,425

[45] Date of Patent: Dec. 29, 1987

[54] CASTING MOULD

[75] Inventor: Richard W. Brosch, Sutton Coldfield, United Kingdom

[73] Assignee: Lymore Limited, United Kingdom

[21] Appl. No.: 30,883

[22] Filed: Mar. 26, 1987

Related U.S. Application Data

[63] Continuation of Ser. No. 319,255, Nov. 9, 1981.

[30] Foreign Application Priority Data

Nov. 22, 1980 [GB] United Kingdom ..... 8037513

[51] Int. Cl.[4] ..... B22D 11/00

[52] U.S. Cl. ..... 164/418; 164/443

[58] Field of Search ..... 164/137, 339, 348, 418, 164/443, 485

[56] References Cited

U.S. PATENT DOCUMENTS

| | | | |
|---|---|---|---|
| 2,767,448 | 10/1956 | Harter | 164/443 |
| 3,809,148 | 5/1974 | Pulsifer | 164/443 |
| 4,374,539 | 2/1983 | Colombo | 164/443 |

FOREIGN PATENT DOCUMENTS

| | | | |
|---|---|---|---|
| 233335 | 4/1961 | Australia | 164/443 |
| 1243866 | 1/1962 | France | 164/348 |
| 1593773 | 6/1970 | France | 164/443 |
| 2361955 | 4/1978 | France | 164/137 |

*Primary Examiner*—Nicholas P. Godici
*Assistant Examiner*—Richard K. Seidel
*Attorney, Agent, or Firm*—C. O. Marshall, Jr.

[57] ABSTRACT

In a casting mould and cooling unit for use in the continuous casting of molten metal, the layers of lubricious, non-wetting material such as graphite (12) bounding the solidification chamber (10) of the mould are secured to the copper cooling jacket walls (14) through the agency of interfitting ribs and grooves (18,20) and a layer (22) of bonding material so as to afford good thermal conduction between the layers (12) and walls (14) even if a gap develops at the interface. The interfitting ribs and grooves are so shaped that each wall (14) and the corresponding layer (12) can be assembled by bringing them together facewise on. At least some of the grooves (20) are of re-entrant form to provide a mechanical key so as to reduce the possibility of a gap developing at the interface.

13 Claims, 1 Drawing Figure

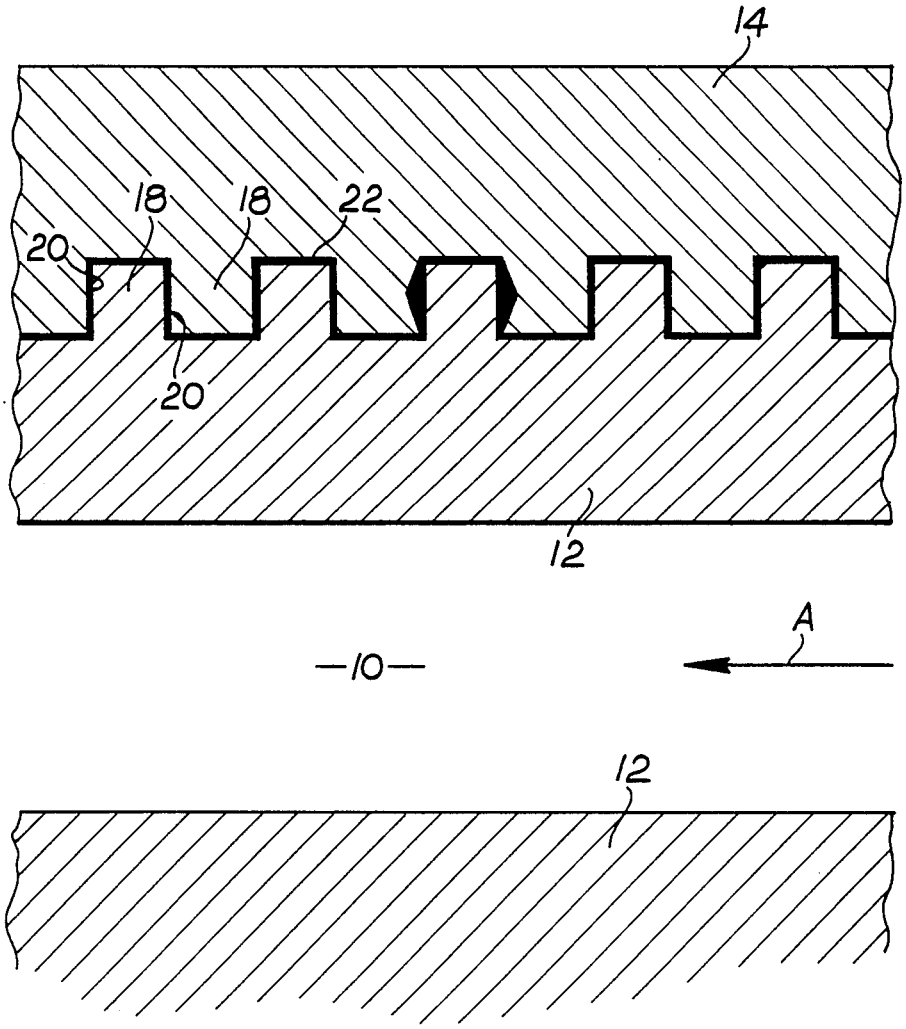
14
18
18
22
20
20
12
A
10
12

CASTING MOULD

This application is in continuation of application Ser. No. 319,255 dated 9th Nov. 1981 pending.

This invention relates to a casting mould for continuous casting of molten metals such as copper, aluminium and ferrous alloys.

In the process of continuous casting, solidification of the molten metal takes place as the metal flows through the mould which is formed with a solidification chamber whose cross section corresponds with the desired cross section of the cast material. Thus, for casting of strip or slab, the solidification chamber of the mould has a generally rectangular cross section and for rod casting it has a generally circular section.

Typically continuous casting moulds comprise an assembly of graphite blocks forming a lining layer defining the solidification chamber with an inlet connected to a source of molten metal and an outlet from which the solidified metal exits, and a cooling system by means of which thermal energy is extracted from the molten metal via the graphite blocks in order to solidity or freeze the metal. Graphite is widely used as the mould material because of its relatively good thermal conductivity, its non-solubility with respect to the metal being cast, its relatively low coefficient of expansion and its lubricating and non-wetting properties. The type of cooling system in common use consists of a copper jacket with means for circulating water through the jacket. Conventionally, the graphite blocks are fastened to the adjacent metal layer constituting the jacket walls by means of a number of screwthreaded or other studs or pins, one example of this type of mould assembly is described in U.S. Pat. No. 3,809,148. This type of known arrangement suffers from the drawback in use that the graphite blocks tend to flex away from the copper jacket walls especially in those regions which are not mechanically fastened to the jacket walls. As a result, a gap may be created at the interface between the graphite blocks and the jacket walls and this has a deleterious affect on the cooling power of the jacket which is reflected in the quality and uniformity of the cast product. Also the fastening studs or pins cause localised stressing and weakening of the lining, particularly as it expands and contracts under heating and cooling, and they act as localised areas having properties of heat transfer differing from the remaining areas of the lining.

One attempt to compensate or allow for the creation of an air gap at the graphite/copper interface in use has been to limit the working thickness of the graphite blocks in order to enhance conduction between the solidification chamber and the cooling system but this, together with the low strength and uncertain service life of the securing arrangements hitherto used in the assembly has afforded very little scope for refurbishing the lining by grinding or machining of the graphite which could otherwise prolong the life of the costly graphite facings of the mould and reduce the time the casting unit is out of service. Moreover, the inwardly facing walls of the copper cooling jacket may also suffer distortion or damage as a result of uneven or other thermal stresses so that as well as replacement of the graphite blocks, re-machining of the jacket walls is frequently necessary and as a consequence the continuous casting unit tends to be out of service for a relatively long time.

French Pat. No. 1,593,773 describes a graphite continuous casting mould having block like cooling elements secured onto its exterior side walls either by pins screwed into the graphite or by the use of interengaged dovetail-like formations. However, it is believed that this dovetail assembly method has not been adopted in practice, at least not on any significant commercial scale and would in any event be costly to manufacture as the interfitting components would have to be very accurately formed to avoid gaps and ensure good and uniform heat transfer and would be difficult to assemble as the graphite mould and the cooling elements would have to be brought together by sliding them endwise on in order to effect interengagement of the dovetail formations. The accurate fitting needed would involve substantial risk of excessive stressing both on assembly and due to differential expansion and contraction of the components.

The object of the present invention is to provide an improved continuous casting mould which is economical to manufacture and assemble, which is particularly effective in use in ensuring uniform cooling and reliable operation with consistent output to high quality standards, and which is durable and long-lived in service with the possibility of repeated, speedy and inexpensive refurbishment to give maximum economy of materials.

In one aspect the present invention provides a mould assembly with said layers being cemented together by a bonding agent at the interface between them; said layers having interfitting protuberances in the form of complementary close fitting rib and groove formations at said interface, at least some of said protuberances including re-entrant portions whose shaping allows the layers to be assembled together facewise-on, and provides a mechanical key resisting subsequent separation of the layers due to the groove formations being filled with the bonding agent on assembly.

In another aspect of the invention there is provided a method of manufacturing a mould assembly including shaping said layers to provide respective protuberances in the form of complementary rib and groove formations which will closely interfit with each other at the interface between the layers when they are brought together, further forming one or both said layers to provide for mechanical keying in conjunction with a bonding agent on assembly to resist subsequent separation of the layers said forming permitting the layers to be brought into interfitting relationship facewise on, and assembling the layers together facewise on with use of a bonding agent to cement them together.

Although the invention is especially applicable to mould assemblies employing graphite as the lining material, other lining materials may be used especially in circumstances where graphite is not wholly satisfactory. For example, in the continuous casting of nickel-based alloys, there is a tendency for the carbon to dissolve. An important advantage stemming from the present invention is that the absence of mechanical fixing components such as bolts, studs and the like allows the use of thinner layers of lining material then has been possible with many forms of mould assembly used hitherto. It follows from this that materials having lower heat conductivity than graphite may be employed because the reduced heat conduction from the molten metal to the coolant can be compensated by employing a thinner layer of lining material. Thus, in the continuous casting of nickel-based alloys, the mould lining material may be a highly temperature-resistant, non-carbon containing material. In general, the selection of the particular lining material to be employed will be dictated by the same kind of considerations as apply to graphite, namely the material must have lubricating, non-wetting and appropriate temperature-resistant properties with respect to the material to be cast and it must be substantially non-soluble in the casting metal. Typical alternatives to graphite are boron nitride for use in casting nickel alloys, or silicon carbide both of which have lower heat conductivities than graphite but can be employed as relatively thin layers to compensate for this.

The presence of the interfitting protuberances substantially increases the heat transfer area between the graphite or other lining and the metal layers because, in contrast with those known mould assemblies in which the opposing faces of the graphite and copper are flat, in the mould according to the invention a substantial degree of heat transfer can take place between the lateral faces of the protuberances.

In the preferred form of the invention said protuberances extend generally parallel fashion across at least a major part of one dimension of the respective layer, e.g. the width dimension of the layer if the width dimension is regarded as being transverse to the flow direction of the metal through the solidification chamber. This enables differential expansion of the layers to be accommodated without undue stress, particularly at the input end of the chamber which operates at greatest heat, by a degree of relative movement longitudinally of the protuberances without imposing excessive stress. Preferably the bonding agent used comprises a cement having, for a cement, a comparatively good thermal conductivity; a graphitic cement has been found useful in this respect. It is also preferred that said agent has a fine texture so that it will form a thin layer, and that it cures without shrinkage.

The bonding together of the two layers makes the resulting assembly not only less prone to variation in thermal conductivity but also much stiffer and more robust. The more predictable and uniform thermal conduction between the solidification chamber and the cooling system affords the advantage that the "freezing point" of the molten metal within the solidification chamber is well defined. Equally if not more significant is the fact that it is no longer necessary to employ a relatively thin layer of graphite or other lining to try and compensate for loss of conductivity due to the creation of a gap as in the conventional mould though, as referred to above, thin layers can be used when it is desirable for other reasons e.g. the nature the lining material used.

Thus the mould may be initially produced with layers of graphite of substantial thickness (e.g. up to 35 mm thick compared with 18 mm–20 mm thickness used in conventional moulds). In other words the invention permits use of a much wider range of mould lining thicknesses then hitherto. This allows the graphite lining to be re-ground or machined periodically several times until it is reduced to a minimum thickness of 10–15 mm thereby prolonging the useful life of the mould assembly considerably. This means that compared with existing continuous casting plant using a number of mould assemblies, each assembly need only be out of service for relatively short periods of time during regrinding or re-machining. Thus, production continuity may be maintained with fewer mould assemblies.

Yet another advantage stemming from the more robust arrangement is the reduced likelihood of damage or warping being occasioned to the metal layer i.e. the cooling jacket as the even heat flow gives less chance of thermal warping. Minor warping is catered for by the use of the bonding agent which will resist separation of the layers. Hitherto, it has been frequently found necessary to re-grind the inwardly directed faces of the metal cooling jacket layer due to distortion as well as to replace the graphite layers.

It will be observed that the interengaging formations provided on the two layers are so shaped that the layers can be brought together facewise-on during assembly (i.e. by bringing the layers into abutment by relative movement in a direction normal to the major planes of the layers). This avoids the considerable assembly difficulties that would be encountered in practice with the casting moulds disclosed in French Pat. No. 1,593,773. Moreover, because the two layers are assembled facewise-on the assembly step assists in ensuring that the bonding agent forms a uniform film entirely filling any gaps at the interface without any voids. In contrast, endwise-on assembly would tend to displace any bonding agent used lengthwise of the grooves, with the possible production of voids, and could also lead to localised compaction and possible jamming during the assembly step.

As previously mentioned, the two layers of the completed assembly are mechanically keyed together. This may be achieved by forming at least some of said grooves and or ribs with re-entrant formations e.g. by undercutting one or more of their side faces, which the bonding agent fills so that, when said agent has cured, a mechanical key is obtained. In practice, it has been found that adequate strength is obtained if only a proportion of said grooves or ribs are formed with a re-entrant configuration. To enhance the bonding effect, at least one and preferably both of the faces at the interface between the two layers are conveniently textured or roughened, e.g. by shot blasting. In some applications the mechanical keying may be provided by said texturing or roughening e.g. of one or more side faces of the grooves or ribs to provide micro surface deformations filled by the bonding agent.

The ribs and grooves of the opposing layers will in general interfit closely especially across the width of the grooves so that the thickness of the bonding agent in the gaps between the ribs and grooves is thin thereby affording high shear strength and good conduction. The width of each groove is preferably at least equal to its depth.

In one typical arrangement both the width and depth are substantially equal, e.g. the range of 2.5 to 10.0 mm.

In another arrangement the ribs and grooves are from 8 to 15 mm in width but of lesser height/depth e.g. 4 to 6 mm. The broader ribs on the copper or other metal layer provide better accommodation for bolts or other elements used to assemble the cooling jacket without any risk of said elements breaking into the grooves of the metal jacket or into the graphite or other lining.

The configuration number and spacing of the grooves may vary widely in practice but preferably the arrangement will be such that, at the interface between the two layers, the grooving arrangement results in an increase of at least 25%, and more preferably at least 100%, in the opposed areas between said layers compared with the case where the opposing areas are constituted by flat, ungrooved faces of said layers.

One example of the present invention is illustrated in the accompanying drawing the sole FIGURE of which is a diagrammatic cross section through part of a continuous casting mould according to the invention, the section being taken parallel to the direction of metal flow through the mould.

Referring now to the drawing, only part of the upper and lower walls bounding the solidification chamber 10 of the mould are shown. The chamber 10 may be of generally rectangular cross section and in use will be connected to the outlet of a melting or holding furnace of a horizontal or vertical continuous casting plant so that the molten metal enters an inlet of chamber 10 and flows in the direction of arrow A towards an outlet at which the solidified metal exits from the mould under the action of withdrawal rolls.

The upper and lower walls of the solidification chamber 10 are bounded by layers of graphite (or similar material) 12 which are secured to the inwardly facing copper walls 14 of the otherwise conventional water cooling jacket through the agency of an interfitting groove and rib arrangement. The ribs 18 and grooves 20 are generally complementary in shape and a layer 22 of bonding agent, such as graphitic cement, is sandwiched between the metal and graphite layers 12, 14. It is important that the ribs and grooves should interfit closely especially with respect to their vertical faces as seen in the drawing so that, in these spaces, the cement layer is relatively thin thereby giving high shear strength and good conduction of heat from the graphite layer 12 to the copper cooling jacket wall 14.

It will be noted that the side walls of one of the grooves 20 (which is shown as being in the layer 14 but may alternatively be in the layer 12) are undercut to give re-entrant configurations which are filled with the cured cement so as to form a mechanical key supplementing the bonding effected by the cement. A number of such re-entrant grooves will be provided at intervals so as to reduce the tendency for separation and development of a gap at the interface between the layers 12 and 14. It will be observed that even if such a gap did develop, it will not appreciably affect conduction between the layers 12 and 14 because substantial conduction can still take place via the side walls of the interfitting grooves and ribs.

An important feature of the invention is that the shaping of the ribs and grooves 18, 20 is such that the layers 12, 14 can be assembled together by bringing them together facewise on, i.e. by relative movement perpendicularly to the interface therebetween. This not only simplifies assembly of the layers 12, 14 together but also ensures that a smooth uninterrupted layer of bonding agent is maintained over the entire interface without the risk of localised cool spots and ensures that the cement is squeezed into and fills the re-entrant configurations prior to curing.

Although one embodiment of the invention is illustrated in the accompanying drawing, it is to be understood that this is merely exemplary and many variations are possible within the scope of the broader definitions of the invention contained herein.

Having now described my invention what I claim is:

1. A mould assembly for continuous casting comprising a lining formed as a layer of a lubricious non-wetting material defining a solidification chamber into which molten metal is flowed in use, and a cooling jacket having a cooling system through which liquid coolant is passed in use including a layer of metal interposed between said lining layer and the coolant, wherein the improvement comprises said layers being cemented together by a bonding agent at the interface between them; said layers having interfitting protuberances in the form of complementary close fitting rib and groove formations at said interface, at least some of said protuberances including re-entrant portions whose shaping allows the layers to be assembled together facewise-on and provides a mechanical key resisting subsequent separation of the layers due to the groove formations being filled with the bonding agent on assembly.

2. An assembly as in claim 1 wherein the lining is formed of graphite.

3. An assembly as in claim 2 wherein the thickness of the lining is initially up to 35 mm allowing for substantial reduction in successive refurbishment during service down to an operative thickness of 15 to 10 mm.

4. An assembly as in claim 1 wherein said re-entrant portions are undercut side faces of said protuberances.

5. An assembly as in claim 1 wherein the protuberances extend in generally parallel fashion across the layers in a direction transverse to the flow direction of the metal through the chamber.

6. An assembly as in claim 1 wherein the width of each groove formation is at least equal to its depth.

7. An assembly as in claim 6 wherein the width and depth are substantially equal.

8. An assembly as in claim 7 wherein the width and depth are in the range 2.5 to 10 mm.

9. An assembly as in claim 1 wherein the protuberances result in an increase of at least 25%, and preferably at least 100% in the opposed areas of the interface between the layers composed with the area if the layers had no protuberances but were flat.

10. An assembly as in claim 1 wherein at least one of the layers at said interface is textured or roughened.

11. A mould assembly for continuous casting comprising a lining formed as a layer of a lubricious non-wetting material defining a solidification chamber into which molten metal is flowed in use, and a cooling jacket having a cooling system through which liquid coolant is passed in use including a layer of metal interposed between said lining layer and the coolant, wherein the improvement comprises said layers being cemented together by a bonding agent at the interface between them; said layers having interfitting protuberances in the form of complementary close fitting rib and groove formations at said interface, and one or both said layers being formed to provide mechanical keying which in conjunction with the bonding agent resists subsequent separation of the layers while allowing their said assembly facewise-on.

12. A method of manufacturing a mould assembly for continuous casting including the steps of forming a layer of a lubricious non-wetting material such as graphite which is to constitute part of a lining defining a solidification chamber of the assembly, and forming a layer of metal substrate which is to constitute part of an outer cooling jacket of the assembly; wherein the improvement comprises shaping said layers to provide respective protuberances in the form of complementary rib and groove formations which will closely interfit with each other at the interface between the layers when they are brought together, further forming one or both said layers to provide for mechanical keying in conjunction with a bonding agent on assembly to resist subsequent separation of the layers said forming permitting the layers to be brought into interfitting relationship facewise on, and assembling the layers together facewise-on with use of a bonding agent to cement them together.

13. A method as in claim 12 wherein said further forming includes the undercutting of one or more side faces of at least some of said formations of one or other of the layers to provide a re-entrant configuration for said mechanical keying.

* * * * *